US012751504B1

(12) United States Patent
Yilma-Kassaye

(10) Patent No.: US 12,751,504 B1
(45) Date of Patent: Oct. 6, 2026

(54) EVERYDAY BRASSIERE FEATURING A SINGULAR FRONT ADJUSTABLE SUPPLEMENTAL STRAP

(71) Applicant: Beza Yilma-Kassaye, Leesburg, VA (US)

(72) Inventor: Beza Yilma-Kassaye, Leesburg, VA (US)

(73) Assignee: Global Skin Palace LLC, Leesburg, VA (US)

( * ) Notice: Subject to any disclaimer, the term of this patent is extended or adjusted under 35 U.S.C. 154(b) by 0 days.

(21) Appl. No.: 19/391,305

(22) Filed: Nov. 17, 2025

Related U.S. Application Data

(63) Continuation of application No. 19/346,494, filed on Sep. 30, 2025, now abandoned.

(51) Int. Cl.
*A41C 3/00* (2006.01)
*A41C 3/12* (2006.01)

(52) U.S. Cl.
CPC ..... *A41C 3/0028* (2013.01); *A41C 3/12* (2013.01)

(58) Field of Classification Search
CPC ..... A41C 3/12; A41C 3/0028
USPC ..... 450/86
See application file for complete search history.

(56) References Cited

U.S. PATENT DOCUMENTS 1,648,776 A * 11/1927 Mcorin ..... A41F 15/02 2/323
2,649,639 A * 8/1953 Carlin ..... A41F 15/02 2/323
3,456,457 A * 7/1969 Cass ..... A44C 25/00 63/36
4,612,935 A * 9/1986 Greifer ..... A41F 15/002 2/268
5,823,851 A * 10/1998 Dicker ..... A41C 3/0057 450/74
5,868,601 A * 2/1999 Kelemencky ..... A41C 3/0028 450/59
6,006,364 A * 12/1999 Newsom ..... A41F 15/02 450/86
6,110,007 A * 8/2000 Rittmann ..... A41C 1/10 450/86
D433,650 S * 11/2000 Gable ..... D2/706
6,163,937 A * 12/2000 McKinnis ..... A41F 15/02 2/323
6,179,687 B1 * 1/2001 Lee ..... A41F 15/002 450/88

(Continued)

*Primary Examiner* — Gloria M Hale

(57) ABSTRACT

The invention disclosed is directed to an improvement of everyday bras, whether soft-cup or padded bras, specifically featuring a unique adjustable supplemental strap, with sliding buckles, anchored between the left and right cups, approximately one to two quarters of an inch below the conventional vertical strap connections on each side of the cups. By tightening or loosening this strap, which lays horizontally on the wearer unlike the two standard straps positioned in a vertical fashion, the wearer can draw the bust closer together towards the medial using the adjustable strap functionality, thereby improving overall breast support and redistributing weight away from the shoulders. This adjustable support system provides enhanced comfort, stability, and overall slimmer or more streamlined visual silhouette beyond what is offered by traditional underwire bras.

4 Claims, 6 Drawing Sheets

(56) References Cited

U.S. PATENT DOCUMENTS

| | | | | |
|---|---|---|---|---|
| 7,819,721 | B1 * | 10/2010 | Messier | A43B 3/0078 2/244 |
| 8,241,090 | B2 * | 8/2012 | Michael | A41F 15/02 450/86 |
| 8,257,139 | B2 * | 9/2012 | De Sousa | A41C 3/08 450/86 |
| 9,427,030 | B2 * | 8/2016 | Buescher | A41C 3/12 |
| 2010/0178847 | A1 * | 7/2010 | Buriak | A41C 3/0064 450/86 |
| 2011/0201251 | A1 * | 8/2011 | De Sousa | A41C 3/08 450/28 |
| 2013/0109276 | A1 * | 5/2013 | Sporn | A41C 3/10 450/57 |

* cited by examiner

EVERYDAY BRASSIERE FEATURING A SINGULAR FRONT ADJUSTABLE SUPPLEMENTAL STRAP

RELATED APPLICATION

This application claims the benefit of application Ser. No. 19/346,494 filed Sep. 30, 2025, now abandoned.

STATEMENT REGARDING FEDERALLY SPONSORED RESEARCH OR DEVELOPMENT (Not Applicable)

REFERENCE TO A SEQUENCE LISTING, A LARGE TABLE, OR A COMPUTER PROGRAM LISTING APPENDIX ON READ-ONLY OPTICAL DISC (Not Applicable)

BACKGROUND OF THE INVENTION

Field of the Invention

The present invention relates generally to the field of undergarments, specifically to an improved brassiere (bra). More particularly, it relates to an auxiliary strap system that provides an enhanced adjustable lift and shaping of the breasts in addition to conventional bra straps.

Description of the Background

As defined under A41C, bras are undergarments made to support or shape breasts, and typically have connected cups. These bras may be strapless, backless, or made with pad or gel inserts into bra pockets. Bras with cups, underwires, shoulder straps, and back bands are well-known from prior art and are widely manufactured in many forms. Traditional bras with or without underwires still fail to provide a balance between support, comfort, and adjustability, particularly for those with larger breasts requiring larger bra sizes and greater support.

Conventional bras provide lift and shaping but often rely solely on two fixed shoulder straps, causing strain due to uneven weight distribution and discomfort on the shoulders from tightened straps. Wireless bras tend to be more comfortable, especially for those with larger breasts, but these may lack sufficient structured support for proper lift and shaping where underwire bras perform better. Additionally, most traditional everyday bras lack customizable support options and do not adequately address weight distribution of larger breasts.

BRIEF SUMMARY OF THE INVENTION

The present invention relates to an undergarment, a bra in particular, made with an adjustable, convertible and/or removable strap sewn between the two soft cups that can anchor the breasts closer together through the pull-in mechanism of the mentioned innovation and redistribute tension away from the shoulders. This invention solves the aforementioned problems by introducing an improvement, which is a modular internal support system that can be removed or adjusted, featuring traditional shoulder straps combined with this additional supplemental strap designed to anchor breast weight via a pull-in effect for better distribution. Traditional stitch construction methods would be used for reliability and ease of manufacturing.

It is an objective of this technical improvement to address or resolve traditional and existing bra limitations by integrating the aforementioned invention, which is a unique, adjustable supplemental strap at the front of the bra, extending from one cup area or side to the other, designed to improve load distribution. It is also an objective of this invention to allow the wearer to control the level of lift and support, reduce shoulder strain, and minimize the bust appearance by creating a narrower, compact silhouette. This bra is made in a traditional fashion as a standard bra otherwise, including a soft-cup or light-padded cup style without or with an underwire structure for shaping and lift, as well as standard primary shoulder straps for basic support.

The invention is an improvement to everyday bras, with or without underwires, with the primary innovative feature being the adjustable supplemental front strap that connects near the upper portion of each soft-cup, above the gore, and placed approximately one half to one inch below the connecting vertical, adjustable shoulder straps on each side of the cups, and extends or connects, via standard reinforced stitching, horizontally from one cup (left or right side) to the opposite side. By tightening or loosening this strap, which is fashioned like shoulder straps only shorter than standard straps, the wearer can increase or decrease the anchoring effect of the bra, adjust the sideward projection and lift of the breasts, reducing reliance on the two traditional shoulder straps for support. This supplemental strap is to serve as an improvement to an otherwise traditional, everyday bra by enhancing support, redistributing weight, and improving comfort. It is constructed with traditional methods and designed for daily wear.

It is a further objective of this improved bra to enhance comfort, improve posture and physical appearance by providing a unique adjustable support system beyond what is available in conventional everyday bras.

DETAILED DESCRIPTION OF THE INVENTION

Figure 1:
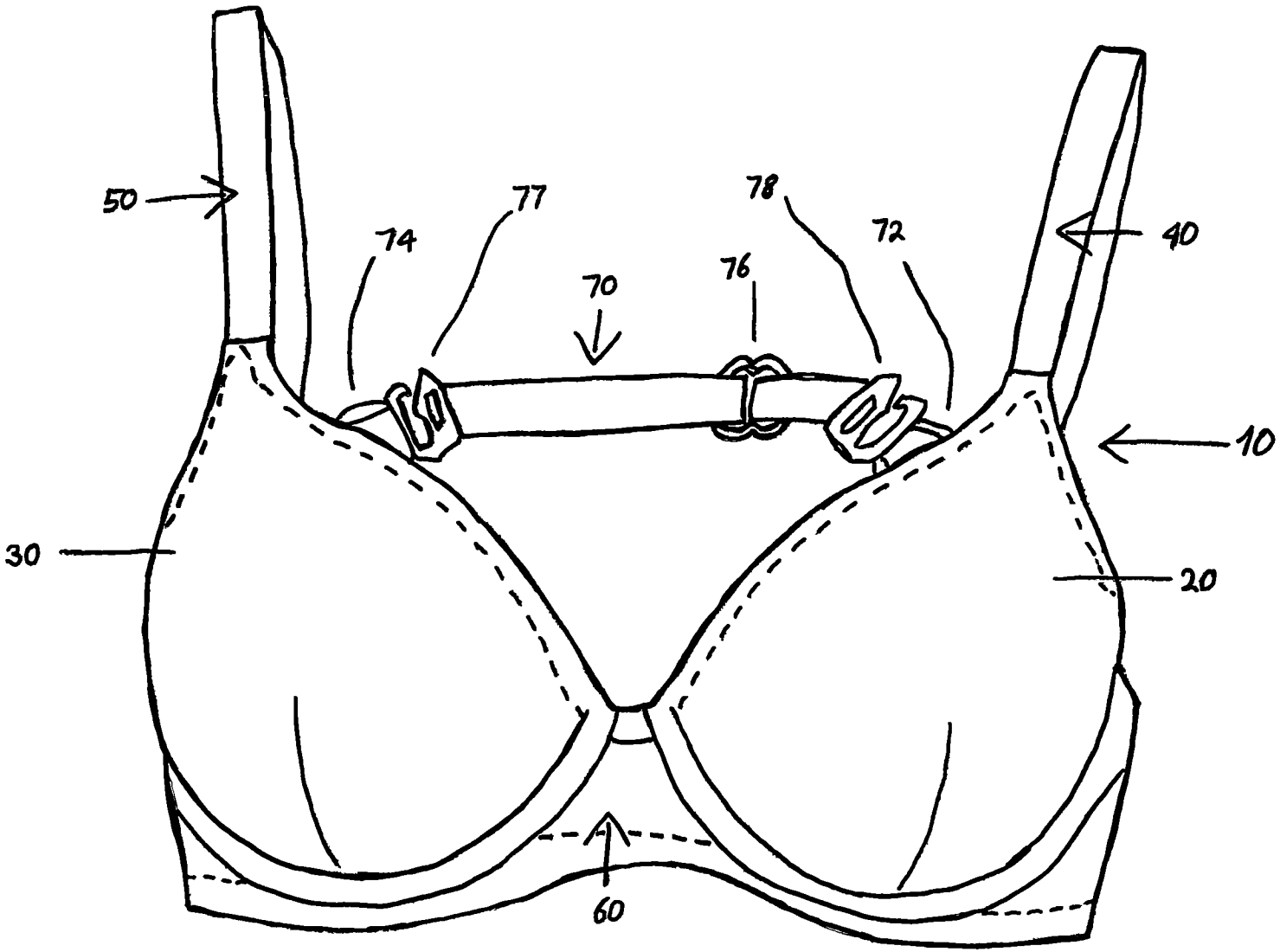
FIG. 1 is a front view of the bra illustrating the front adjustable supplemental strap in a convertible and detachable embodiment as well as the left and right soft-cups, with or without underwires, and primary shoulder straps.

The following describes in full detail with reference to the various numerical designations, each number having the same significance in each of the different figures. Conventional bras include a left cup 20 and right cup 30 with or without underwires for shaping, primary shoulder straps on the left 40 and right 50 side for suspension, and a back band for torso anchoring. These features are known in the art and not claimed herein, except as necessary to cooperate with the present invention.

The invention is an improvement to such conventional everyday bras through the addition of a uniquely positioned singular adjustable and detachable strap or a sewn-on strap 70, and the overall function of such bras. A further description of basic bras is included here first before going into more details as these parts cooperate all together.

Traditionally, a bra is made of left 20 and right 30 cups, a back band, under-band, wings and shoulder straps 40 and 50. Some bras are made with light foam, which may provide a more even rounded shaping effect, but these bras are typically undesirable for those who have larger breasts as these add more volume, which may not be the desired effect sought by the wearer. Rather, bras with soft-cups are made of fabrics, such as cotton, nylon, silk, or polyester and do not have any type of foam padding, hence granting the wearer a more comfortable, natural look and feel.

Furthermore, everyday bras may be made with underwires, which provide better shaping of the breasts. However, women with larger figures and breasts may not like such underwire bras due to some discomfort they may experience caused by the wires and straps that dig into their skin after wearing them for longer hours.

To clarify when describing "larger" or "smaller" sizes, it is in terms of the cup size or band size of bras. For example, cup size "A" is smaller than a "B" cup size, and size "DD" is larger than a "C" cup, so on and so forth. Additionally, band sizes, which are numerical, may be described larger as the band sizes increase. For example, a band size of 34 is smaller in circumference when closed via the bra's hooks than a band size of 38, etc.

The following description sets forth various embodiments of the present invention. It should be understood that the embodiments described are illustrative and that other modifications, variations, and equivalents may be employed without departing from the scope of the invention.

In one embodiment, the invention comprises a brassiere including a pair of breast cups, 20 and 30, a band 60, and a shoulder strap system, 40 and 50. The shoulder strap system includes a first set of straps extending from the upper region of each cup to the back portion of the band. An additional adjustable strap 70 is disposed across the front of the wearer, extending between the two cups 20 and 30. This strap is removable and attachable at each end by a hook-and-tab 72 and 78, or equivalent connector, thereby allowing the wearer to secure, remove, or replace the strap as desired.

In another embodiment, the additional strap is integrally sewn into each cup, providing a permanent connection. The strap may include an adjustment mechanism such as a sliding buckle, ladder lock, or hook-and-eye segment to vary the strap length and therefore the degree of support across the front of the wearer.

In yet another embodiment, the bra is constructed with underwire supports beneath each cup. The front strap may also include elasticized segments to permit limited stretching while maintaining support.

In an alternative embodiment, the bra is configured as a soft-cup garment without underwires. In this version, the additional front strap functions as a stabilizing element, reducing horizontal cup displacement and improving comfort for wearers who prefer non-wired bras.

In another embodiment, the invention is incorporated into a sports bra configuration. The additional strap extends across the chest and is formed of elasticized material to provide compression. The strap may be permanently integrated into the garment or removably attachable using fasteners such as snaps, Velcro®, or magnetic closures.

In yet another embodiment, the additional strap includes decorative or aesthetic features. For example, the strap may be formed of lace, mesh, or ornamental materials, thereby functioning both as a support mechanism and as a fashion element.

In certain embodiments, multiple additional straps may be employed. For instance, two or more parallel straps may extend across the front of the wearer, either fixed or adjustable, to provide enhanced support or varied styling.

It should be understood that the materials, attachment mechanisms, strap geometries, and garment configurations described herein are illustrative. The invention may be embodied in numerous variations, including but not limited to wired and non-wired bras, convertible bras, strapless bras with optional strap addition, sports bras, and other support garments incorporating the additional adjustable strap system described.

Referring to FIG. 1, the bra comprises soft-cups constructed of stretchable, moisture-wicking fabric. Each soft-cup may or may not include an underwire along its lower edge for lift and shaping.

Primary Shoulder Straps are anchored at the upper edges of the soft-cups and at the upper back band. These straps may be wide or standard and cushioned for wearer comfort. They may also be front-adjustable using conventional sliders.

Reflected in FIG. 1 is a front view of the supplemental adjustable front strap 70, the unique element of this invention. This strap 70 may be wider in terms of width of the strap or narrower than the primary straps. It anchors near the upper portion of each soft-cup and extends horizontally from one cup 20 toward an attachment point on the opposite side cup 30. It includes an adjustment mechanism 76—such as a buckle or slider—to allow the wearer to tighten or loosen the strap. When tightened, the strap 70 pulls the breasts closer to the medial, redistributing support tension and reducing shoulder load. When loosened, it provides a more relaxed fit, though if too loose may lose the intended purpose. This view illustrates a completely detachable supplemental front strap 70, with left and right loops, 72 and 74, for the hooks 78 and 77 to fasten onto. The adjustable slider 76 allows the wearer to tighten or loosen the supplemental strap 70.

Figure 2:
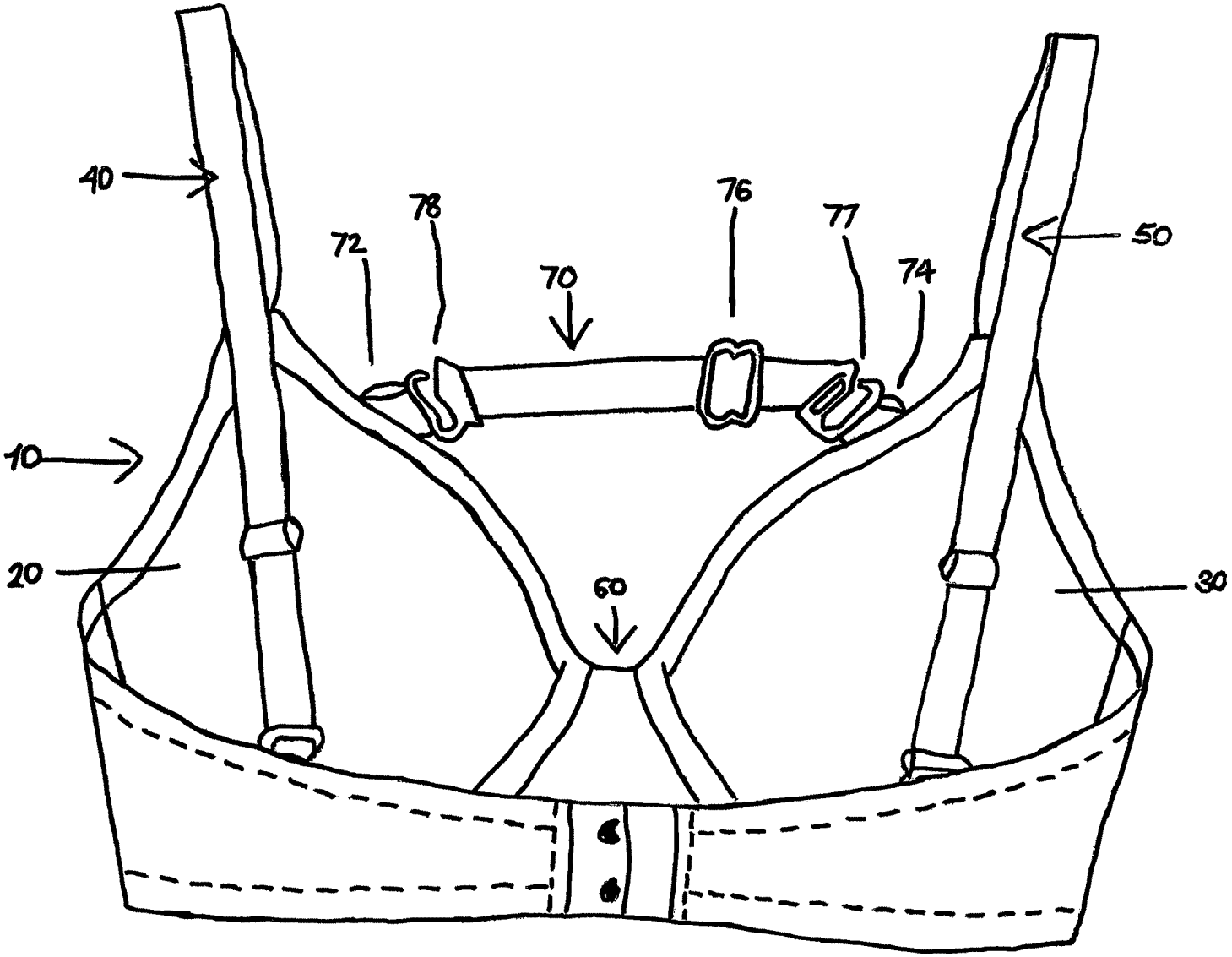
FIG. 2 is a rear view of the bra showing the attachment points of the convertible, supplemental strap, back band and traditional hook and eye closure.

Referring to FIG. 2, the bra 10 as seen from the back shows the front supplemental adjustable strap 70 showing an inward facing buckle/slider 76. The buckle 76 in this way allows for minimal showing under clothing items as the bump is somewhat hidden.

Figure 3A:
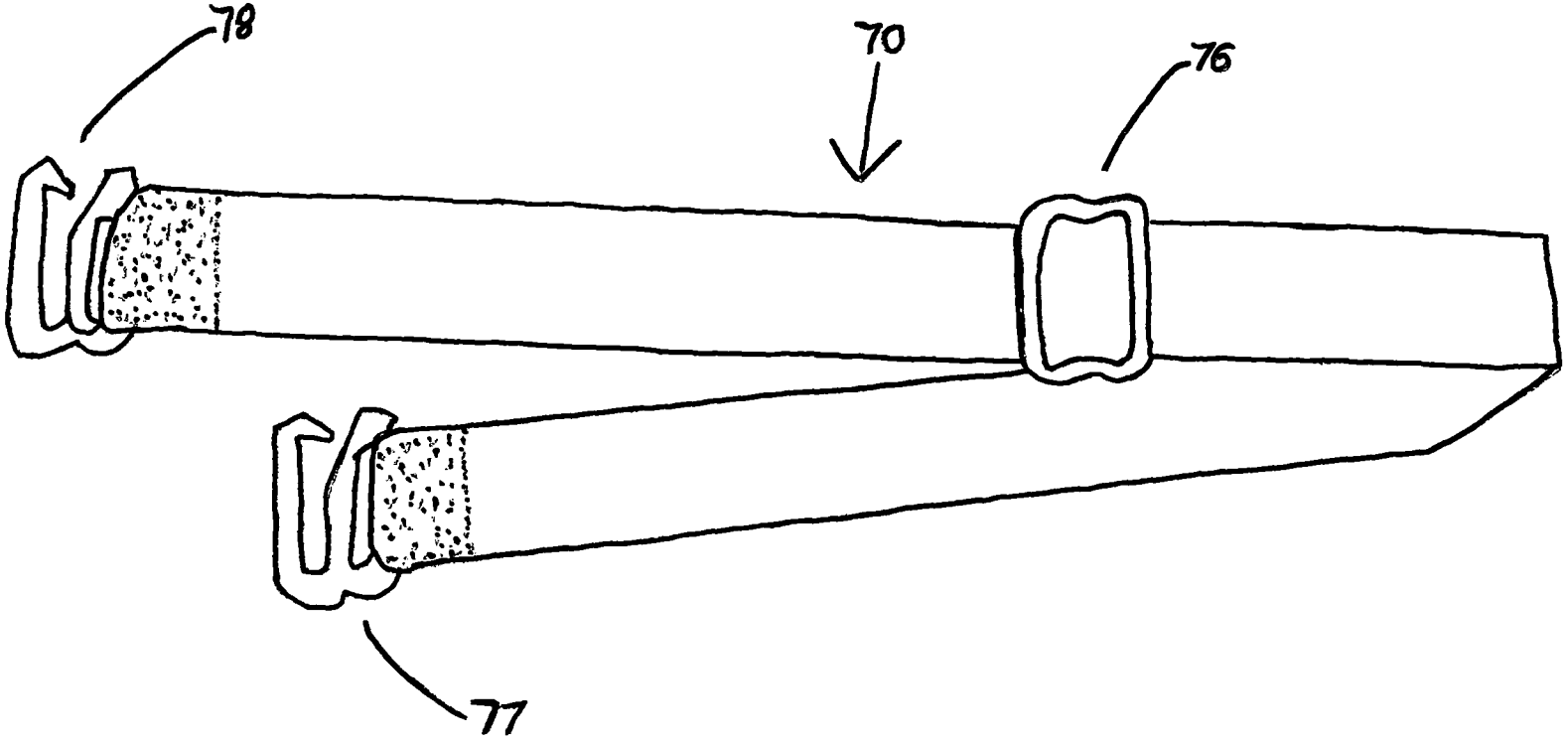
FIG. 3A is an exploded view showing the removable and convertible supplemental strap with an adjustable buckle

FIG. 3A solely reflects a fully detachable strap 70 to detail different embodiment options. This supplemental strap 70 going across the chest region may be visible with certain clothing items, such as V-necks t-shirts or V-neck sweaters. Therefore, clear elastic straps with the same adjustable mechanism may be utilized, as opposed to traditional solid and elastic fabric straps.

Figure 3B:
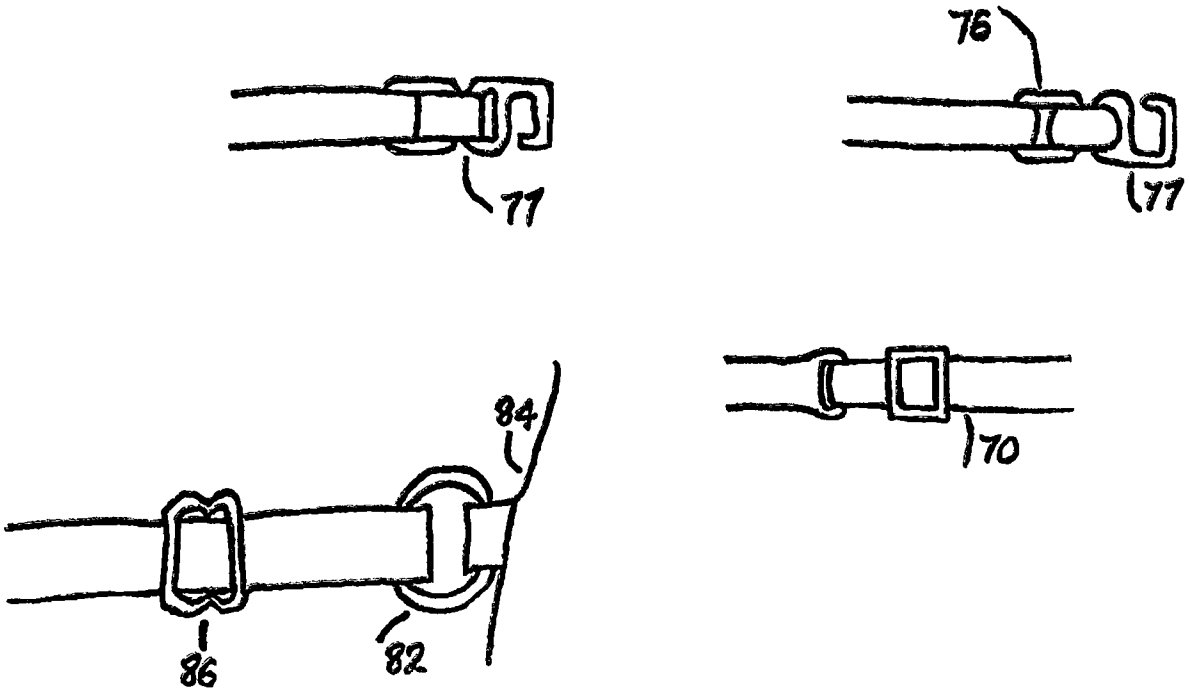
FIG. 3B illustrates two different mechanisms for the attachment of the supplemental strap: one which allows complete removal with the swivel hook and loop, the other with a permanent, non-detachable, sewn-on ring attachment on one end of the strap.

Referring to FIG. 3B, two different means of attaching the supplemental strap 70 are shown. The fully detachable version with the swivel hook 77 allows interchanging the strap with either a fabric strap or a clear one. An alternative embodiment illustrates the permanent version with a loop and ring attachment 82 to the cup 84.

Figure 4:
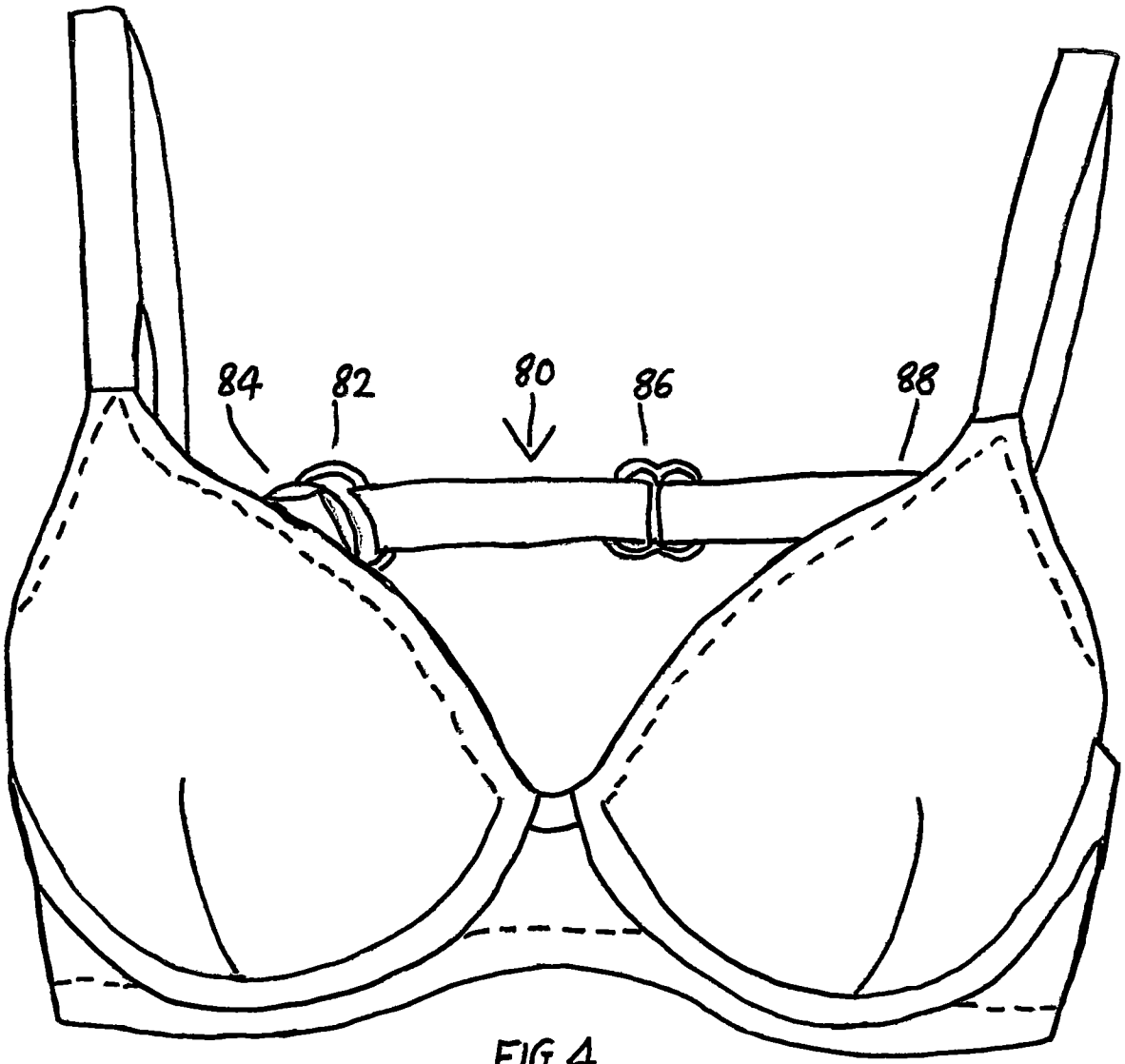
FIG. 4 is a front view of the bra showing the front adjustable supplemental strap in a sewn-on embodiment.

FIG. 4 is a front view of the standard everyday bra, this time showing a permanent ring-style 82 attachment on one end of the cup of a varied front adjustable strap 80 and sewn into the cup on the other side 88. Note should be made that the width of the strap in relation to the diameter of the ring should be relatively lower to prevent the strap from folding at the ring or bunching up into the ring to allow for a smooth appearance underneath clothing items of the wearer.

Figure 5:
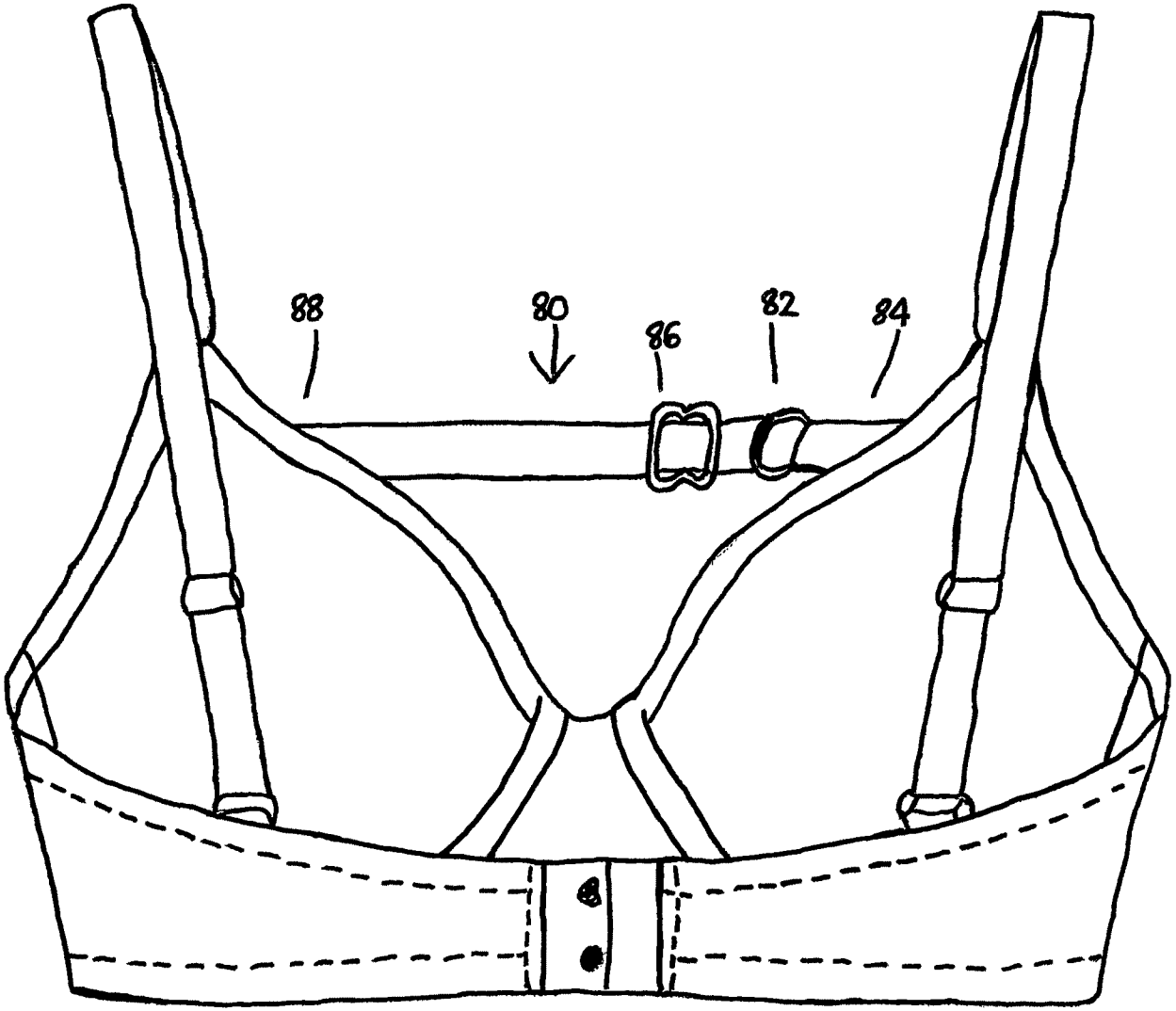
FIG. 5 is a detailed view of the adjustable buckle or fastening mechanism on the supplemental strap.

The last and final drawing, FIG. 5, is a rear view of the improved bra with the second varied supplemental strap 80. All other elements of this strap may remain the same as the aforementioned details.

Optional Comfort and Fabric Features:

Inner lining of cups may include breathable mesh for ventilation.

Cups may have light compression zones to subtly shape the bust.

All seams are traditionally stitched for durability and ease of manufacturing.

Rather than focusing on aesthetics, this bra is primarily made for purposes of comfort and confidence for the wearer so they know aesthetically, they look as good as possible, and comfort-wise, they have an additional source of support through the improved everyday bra with the innovative additional strap. Millions of women spend millions of dollars to increase their bust appearance through breast augmentation, but for those who are well-endowed naturally and wish to slightly minimize their bust appearance for a more polished and moderate look without sacrificing comfort, this improved bra may be a good solution.

The invention claimed is:

1. A breast cleavage adjustment brassiere comprising:

a pair of cups including a first cup and a second cup;

each first and second cup with or without underwires therein;

one or two primary shoulder straps, and a back band;

said shoulder straps each extending from each one of said cups to said back band;

and a supplemental adjustable strap having a first end attached to an upper edge of said first cup and a second end attached to an upper edge of a second cup;

said supplemental adjustable strap extending in a horizontal direction and configured to extend across a medial area of a wearer's chest;

said supplemental adjustable strap having a first hook mechanism sewn to said strap first end and a second hook attached to said strap second end;

each cup having a top edge wherein a ring or fabric loop is sewn to each of said first and second cup top edges;

said first hook attached to said supplemental adjustable strap first end secured to said ring or fabric loop to secure said supplemental adjustable strap to said first cup and said second end of said supplemental adjustable strap having a second end with a second hook that is secured to said second ring or fabric loop on said second cup top edge;

said attachment of said supplemental adjustable horizontal strap to said first and second cup edges along with said adjustment of said adjustment mechanism to draw in or tighten said adjustable strap and thereby pulling said first and second cups inwardly in a medial direction to tighten said cups on a wearer's bust to thereby increase the cleavage of the wearer's breasts by lifting said cups inwardly and upwardly.

2. The breast cleavage adjustment brassiere as claimed in claim 1 and further wherein the adjustment mechanism comprises a buckle, a slider, hook, or hook-and-loop fastener.

3. The breast cleavage adjustment brassiere as claimed in claim 1 and further wherein the supplemental adjustable strap is detachable.

4. The breast cleavage adjustment brassiere as claimed in claim 1 and further wherein tightening the strap increases the brassiere cup lift by shifting the breast cup load from the shoulder straps to the brassiere cups.

* * * * *